US011933172B2

(12) United States Patent
Spatz et al.

(10) Patent No.: US 11,933,172 B2
(45) **Date of Patent: *Mar. 19, 2024**

(54) METHOD, APPARATUS BY METHOD, AND APPARATUS OF GUIDANCE POSITIONING MEMBERS FOR DIRECTIONAL DRILLING

(71) Applicant: XR LATERAL LLC, Houston, TX (US)

(72) Inventors: Edward Spatz, Spring, TX (US); Michael Reese, Houston, TX (US); David Miess, Spring, TX (US); Gregory Prevost, Spring, TX (US)

(73) Assignee: XR Lateral LLC, Houston, TX (US)

( * ) Notice: Subject to any disclaimer, the term of this patent is extended or adjusted under 35 U.S.C. 154(b) by 376 days.

This patent is subject to a terminal disclaimer.

(21) Appl. No.: 17/102,618

(22) Filed: Nov. 24, 2020

(65) Prior Publication Data

US 2021/0246727 A1 Aug. 12, 2021

Related U.S. Application Data

(62) Division of application No. 15/667,704, filed on Aug. 3, 2017, now Pat. No. 10,890,030.

(Continued)

(51) Int. Cl.
*E21B 7/04* (2006.01)
*E21B 7/06* (2006.01)

(Continued)

(52) U.S. Cl.
CPC ..... *E21B 7/04* (2013.01); *E21B 7/067* (2013.01); *E21B 7/068* (2013.01); *E21B 17/20* (2013.01);

(Continued)

(58) Field of Classification Search
CPC . E21B 7/04; E21B 7/067; E21B 7/068; E21B 17/20; E21B 44/00; E21B 44/02

(Continued)

(56) References Cited

U.S. PATENT DOCUMENTS 356,154 A 1/1887 Neelands
1,638,337 A 8/1927 Hutton (Continued)

FOREIGN PATENT DOCUMENTS

CA 2291922 A1 6/2000
EP 530045 B1 4/1997

OTHER PUBLICATIONS

Micon ( Positive Displacement Motors (PDM), Micon drilling , 2015, pp. 1-50) (Year: 2015).*

(Continued)

*Primary Examiner* — Iftekhar A Khan
(74) *Attorney, Agent, or Firm* — Michael S. McCoy; Amatong McCoy LLC

(57) ABSTRACT

Directional drilling is an extremely important area of technology for the extraction of oil and gas from earthen formations. The technology of the present application relates to improved non-stabilizer guidance positioning members for directional drilling assemblies and for drill strings. It also relates to an improved method for analyzing the fit and engagement of a directional drilling assembly in curved and straight wellbores in order to produce improved guidance positioning members. It also relates to a method of designing guidance positioning members for directional drilling. It also relates to drilling directional wellbores using the guidance positioning members of the present technology.

24 Claims, 14 Drawing Sheets

Related U.S. Application Data

(60) Provisional application No. 62/439,843, filed on Dec. 28, 2016.

(51) Int. Cl.
*E21B 17/20* (2006.01)
*E21B 44/00* (2006.01)
*E21B 44/02* (2006.01)
*E21B 47/013* (2012.01)

(52) U.S. Cl.
CPC ..... *E21B 44/00* (2013.01); *E21B 44/02* (2013.01); *E21B 47/013* (2020.05)

(58) Field of Classification Search
USPC ..... 703/10
See application file for complete search history.

(56) References Cited

U.S. PATENT DOCUMENTS 1,667,155 A 4/1928 Higdon
2,919,897 A 1/1960 Sims
3,061,025 A 10/1962 Stockard
3,156,310 A 11/1964 Frisby
3,159,224 A 12/1964 Cleary
3,224,513 A 12/1965 Weeden
3,561,549 A 2/1971 Garrison et al.
3,880,246 A 4/1975 Farris
3,882,946 A 5/1975 Ioannesian et al.
4,270,619 A 6/1981 Base
4,373,592 A 2/1983 Dellinger et al.
4,385,669 A 5/1983 Knutsen
4,407,377 A 10/1983 Russell
4,456,080 A 6/1984 Holbert
4,465,147 A 8/1984 Feenstra et al.
4,485,879 A 12/1984 Kamp et al.
4,491,187 A 1/1985 Russell
4,492,276 A 1/1985 Kamp
4,523,652 A 6/1985 Schuh
4,577,701 A 3/1986 Dellinger et al.
4,618,010 A 10/1986 Falgout et al.
4,623,026 A 11/1986 Kemp et al.
4,667,751 A * 5/1987 Geczy ..... E21B 7/068 175/73
4,690,229 A 9/1987 Raney
4,697,651 A 10/1987 Dellinger
4,715,453 A 12/1987 Falgout, Sr. et al.
4,729,438 A 3/1988 Walker et al.
4,739,843 A 4/1988 Burton
4,775,017 A 10/1988 Forrest et al.
4,807,708 A 2/1989 Forrest et al.
4,842,083 A 6/1989 Raney
4,848,490 A * 7/1989 Anderson ..... E21B 17/1014 175/323
4,862,974 A 9/1989 Warren et al.
4,877,092 A 10/1989 Helm et al.
5,010,789 A 4/1991 Brett et al.
5,042,596 A 8/1991 Brett et al.
5,050,692 A 9/1991 Beimgraben
5,099,929 A 3/1992 Keith et al.
5,099,931 A 3/1992 Krueger et al.
5,115,872 A * 5/1992 Brunet ..... E21B 7/061 166/50
5,131,479 A 7/1992 Boulet et al.
5,139,094 A 8/1992 Prevedel et al.
5,159,577 A 10/1992 Twist
5,181,576 A 1/1993 Askew et al.
5,318,137 A 6/1994 Johnson et al.
5,320,179 A * 6/1994 Roos, Jr. ..... E21B 7/068 175/45
5,333,699 A 8/1994 Thigpen et al.
5,343,967 A 9/1994 Kruger et al.
5,361,859 A 11/1994 Tibbitts
5,458,208 A * 10/1995 Clarke ..... E21B 17/04 175/45
5,673,763 A 10/1997 Thorp
5,812,068 A 9/1998 Wisler et al.
5,857,531 A 1/1999 Estep et al.
5,904,213 A 5/1999 Caraway et al.
5,931,239 A 8/1999 Schuh
5,937,958 A 8/1999 Mensa-Wilmot et al.
5,957,223 A 9/1999 Doster et al.
5,967,246 A 10/1999 Caraway et al.
5,971,085 A 10/1999 Colebrook
5,979,570 A * 11/1999 McLoughlin ..... E21B 7/062 175/45
5,992,547 A 11/1999 Caraway et al.
6,073,707 A 6/2000 Noe et al.
6,079,506 A * 6/2000 Mercer ..... E21B 47/024 175/45
6,092,613 A 7/2000 Caraway et al.
6,109,372 A * 8/2000 Dorel ..... E21B 7/06 175/269
6,116,356 A 9/2000 Doster et al.
6,158,533 A 12/2000 Gillis et al.
6,186,251 B1 2/2001 Butcher
6,213,226 B1 * 4/2001 Eppink ..... E21B 7/064 175/73
6,257,356 B1 7/2001 Wassell
6,325,162 B1 12/2001 Eppink et al.
6,349,780 B1 2/2002 Beuershausen
6,427,792 B1 8/2002 Roberts et al.
6,523,623 B1 2/2003 Schuh
6,722,453 B1 4/2004 Crooks
6,742,605 B2 6/2004 Martini
6,991,046 B2 * 1/2006 Fielder ..... E21B 10/322 175/57
7,207,398 B2 4/2007 Runia et al.
7,562,725 B1 7/2009 Broussard et al.
7,831,419 B2 11/2010 Cariveau et al.
8,061,453 B2 11/2011 Cariveau et al.
8,162,081 B2 4/2012 Ballard et al.
8,176,999 B2 5/2012 Stroud et al.
8,201,642 B2 6/2012 Radford et al.
8,210,283 B1 7/2012 Benson et al.
8,240,399 B2 8/2012 Kulkarni et al.
8,316,968 B2 11/2012 Ferrari et al.
8,448,721 B2 5/2013 Johnson
8,448,722 B2 5/2013 Konschuh et al.
8,550,190 B2 10/2013 Hall et al.
8,757,298 B2 6/2014 Broussard, Jr.
8,763,726 B2 7/2014 Johnson et al.
D710,174 S 8/2014 Moss
D710,175 S 8/2014 Moss et al.
D710,176 S 8/2014 Santamarina
D713,706 S 9/2014 Jing et al.
D717,626 S 11/2014 Dickrede
8,905,159 B2 * 12/2014 Downton ..... E21B 7/062 175/74
9,016,400 B2 4/2015 Clausen et al.
D731,277 S 6/2015 Manwaring et al.
D732,364 S 6/2015 Rinaldis et al.
9,163,460 B2 10/2015 Isenhour et al.
9,556,683 B2 1/2017 Simmons et al.
9,605,482 B2 * 3/2017 Lange ..... E21B 47/024
D786,645 S 5/2017 Svendsen et al.
D793,831 S 8/2017 Russell et al.
D793,832 S 8/2017 Russell et al.
D793,833 S 8/2017 Russell et al.
D813,003 S 3/2018 Chang
9,963,938 B2 5/2018 Foote et al.
2002/0056574 A1 5/2002 Harvey et al.
2002/0070021 A1 * 6/2002 Van Drentham-Susman ..... E21B 29/06 175/73
2002/0112892 A1 8/2002 Taylor
2002/0175006 A1 11/2002 Findley et al.
2003/0010534 A1 * 1/2003 Chen ..... E21B 7/068 175/75
2003/0024742 A1 * 2/2003 Swietlik ..... E21B 17/05 175/325.1
2004/0216921 A1 11/2004 Krueger

(56) References Cited

U.S. PATENT DOCUMENTS

2005/0096847 A1* 5/2005 Huang ..... E21B 44/00 702/9
2005/0150692 A1* 7/2005 Ballantyne ..... E21B 41/0035 166/50
2005/0236187 A1* 10/2005 Chen ..... E21B 17/08 175/75
2006/0196697 A1 9/2006 Raney
2007/0007000 A1 1/2007 Dewey et al.
2007/0007042 A1* 1/2007 Gard ..... E21B 7/046 175/170
2007/0114068 A1* 5/2007 Hall ..... E21B 7/067 175/73
2007/0163810 A1* 7/2007 Underwood ..... E21B 7/04 175/73
2007/0205024 A1 9/2007 Mensa-Wilmot
2007/0235227 A1* 10/2007 Kirkhope ..... E21B 7/10 175/73
2007/0272445 A1 11/2007 Cariveau et al.
2008/0000693 A1 1/2008 Hutton
2008/0047754 A1* 2/2008 Evans ..... E21B 17/1078 175/325.5
2008/0053707 A1* 3/2008 Martinez ..... G01V 11/005 175/73
2008/0075618 A1* 3/2008 Martin ..... B22F 10/28 700/98
2008/0115974 A1 5/2008 Johnson et al.
2008/0190665 A1* 8/2008 Earles ..... E21B 7/06 175/73
2008/0271923 A1* 11/2008 Kusko ..... E21B 41/0085 175/25
2009/0000823 A1* 1/2009 Pirovolou ..... E21B 7/04 175/61
2009/0044980 A1 2/2009 Sheppard et al.
2009/0044981 A1 2/2009 Sheppard et al.
2009/0065262 A1 3/2009 Downton et al.
2009/0107722 A1 4/2009 Chen et al.
2009/0188720 A1 7/2009 Johnson et al.
2010/0006341 A1* 1/2010 Downton ..... E21B 7/064 175/73
2010/0307837 A1* 12/2010 King ..... E21B 7/20 175/425
2011/0031025 A1 2/2011 Kulkarni et al.
2011/0247816 A1* 10/2011 Carter, Jr. ..... E21B 43/26 166/298
2012/0055713 A1 3/2012 Herberg et al.
2012/0234610 A1* 9/2012 Azar ..... E21B 10/43 175/431
2013/0043076 A1 2/2013 Larronde et al.
2013/0175092 A1* 7/2013 Kolpack ..... E21B 47/024 175/45
2013/0180782 A1 7/2013 Ersan et al.
2014/0097026 A1* 4/2014 Clark ..... E21B 17/028 175/73
2014/0110178 A1* 4/2014 Savage ..... E21B 47/02 175/76
2014/0246209 A1 9/2014 Themig et al.
2014/0246234 A1* 9/2014 Gillis ..... E21B 44/00 175/24
2014/0311801 A1 10/2014 Jain et al.
2014/0379133 A1* 12/2014 Toma ..... E21B 44/00 700/275
2015/0101864 A1* 4/2015 May ..... E21B 10/32 175/27
2015/0122551 A1* 5/2015 Chen ..... B23P 15/32 175/426
2015/0152723 A1 6/2015 Hay
2015/0322781 A1* 11/2015 Pelletier ..... G01V 8/10 175/41
2016/0024846 A1* 1/2016 Parkin ..... E21B 4/20 175/57
2016/0024848 A1* 1/2016 Desmette ..... E21B 17/1078 175/74
2016/0115779 A1* 4/2016 Moss ..... E21B 7/04 324/346
2016/0230465 A1 8/2016 Holtz et al.
2016/0265287 A1* 9/2016 Newman ..... E21B 17/1078
2016/0281431 A1* 9/2016 Peters ..... E21B 44/04
2016/0326863 A1* 11/2016 Lange ..... E21B 21/10
2017/0044833 A1 2/2017 Foote et al.
2017/0130533 A1 5/2017 Ling
2017/0234071 A1* 8/2017 Spatz ..... E21B 10/26 175/61
2017/0241207 A1 8/2017 Meier et al.
2017/0342773 A1* 11/2017 Keiser ..... E21B 47/01
2017/0342778 A1* 11/2017 Chen ..... E21B 17/1078
2018/0073301 A1* 3/2018 Russell ..... E21B 7/067
2018/0179831 A1 6/2018 Spatz et al.
2019/0055810 A1* 2/2019 Fripp ..... A61K 47/34

OTHER PUBLICATIONS

Sawaryn et al. (A Compendium of Directional Calculations Based on the Minimum Curvature Method, SPE 84246, 2003, pp. 1-16) (Year: 2003).*
APS Technology, "Rotary Steerable Motor for Directional Drilling." downloaded Nov. 13, 2017 from http://www.aps-tech.com/products/drilling-systems/rotary-steerable-motor, 4 pages.
Felczak, et al., "The Best of Both Worlds—A Hybrid Rotary Steerable System", Oilfield Review; vol. 23, No. 4, Winter 2011, pp. 36-44.
International Search Report and the Written Opinion in PCT Application No. PCT/US2017/017515, dated Apr. 28, 2017, 8 pages.
International Search Report and Written Opinion in PCT Application No. PCT/US 18/41316, dated Sep. 25, 2018, 14 pages.
International Searching Authority, International Search Report and Written Opinion, PCT Patent Application PCT/US2017/066707, dated Apr. 6, 2018, 13 pages.
International Searching Authority, International Search Report and Written Opinion, PCT Patent Application PCT/US2017/066745, dated Feb. 15, 2018, 9 pages.
Kim et al. ("A Novel Steering Sections of Hybrid Rotary Steerable System for Directional Drilling", ICCAS 2014, pp. 1617-1619) ( Year: 2014).
Matheus et al. ("Hybrid Approach to Closed-loop Directional Drilling Control using Rotary Steerable Systems", IFAC Workshop, 2012, pp. 84-89) (Year: 2012).
PetroWiki, "Direction deviation tools," downloaded Nov. 13, 2017 from http://petrowiki.org/Directional_deviation_tools, 5 pages.
Warren et al. ("Casing Directional Drilling", AADE 2005 National Technical Conference and Exhibition, 2005, pp. 1-10) (Year: 2005).
Warren, et al., "Casing Directional Drilling", AADE-05-NTCE-48; American Association of Drilling Engineers (AADE) 2005 National Technical Conference and Exhibition, Houston, Texas, Apr. 5-7, 2005, pp. 1-10.
Non-Final Office Action dated Jul. 8, 2021, during the prosecution of U.S. Appl. No. 15/808,798 [7 pages].

* cited by examiner

METHOD, APPARATUS BY METHOD, AND APPARATUS OF GUIDANCE POSITIONING MEMBERS FOR DIRECTIONAL DRILLING

CROSS-REFERENCE TO RELATED APPLICATION(S)

The present application is a Divisional application of U.S. application Ser. No. 15/667,704 filed on Aug. 3, 2017 (now allowed), which claims priority to U.S. Provisional Patent Application Ser. No. 62/439,843, filed Dec. 28, 2016 (now expired), the disclosure of which is incorporated herein as if set out in full.

TECHNICAL FIELD

The technology of the present application relates to improved non-stabilizer guidance positioning members for directional drilling assemblies and for drill strings. It also relates to an improved method for analyzing the fit and engagement of a directional drilling assembly in curved and in generally straight wellbore sections in order to produce improved guidance positioning members. It also relates to a method of designing guidance positioning members for directional drilling.

BACKGROUND

In the art of oil and gas well drilling, several methods exist to deviate the path of the wellbore off of vertical to achieve a target distanced from directly below the drilling rig. The methods used include traditional whipstocks, side jetting bits, modern Rotary Steerable Systems (RSS), adjustable gauge stabilizers, eccentric assemblies, turbines run in conjunction with a bent sub, and the most employed method, the bent housing Positive Displacement Motor (PDM). Variations, combinations, and hybrids exist for all of the methods listed.

The popularity of the bent housing PDM arises from its relatively low cost, general availability, familiarity to drillers, and known level of reliability. The bent housing PDM has a number of drawbacks, some of which are further described below.

A typical bent housing PDM assembly generally is made up from four primary sections. At the top is a hydraulic bypass valve called a dump sub. Frequently, the dump sub is augmented by a rotor catch mechanism designed to allow the components of the PDM to be retrieved if the outer housing fails and parts below the rotor catch. Next is the power section which is a housing containing a stator section with a lobed and spiraled central passage. A lobed and spiraled rotor shaft is deployed through the center of the power section and in use is caused to rotate as a result of the pressure exerted by drilling fluid pushed down through the power section. Below the power section, the PDM is fitted with a transmission housing that incorporates a prescribed bend angle, typically 0.5 to 4.0 degrees, tilted off of the centerline of the assemblies above. The side opposite the bend angle is typically marked with a scribe and is referred to as the scribe side of the tool. It is this bend angle that defines the amount of theoretical course alteration capability of the PDM steerable system. The course alteration capability of a given assembly is referred to as its "build rate" and is measured in degrees of course change per 100 feet of drilled hole. The resulting curve of the borehole is sometimes referred to as Dog Leg Severity (DLS).

Below the transmission housing is the bearing assembly incorporating, among other things, thrust bearings, radial bearings, and a drive shaft. The bearing package transmits rotary torque and down force from the motor to the bit which is threaded into a connection on the distal end of the bearing package. It should be noted that the traditional API connection of the bit to the bearing assembly comprises a considerable length which is generally deemed problematic to achieving targeted build rate.

The outer diameter of the bearing assembly is frequently mounted with a near bit stabilizer to keep the lower part of the assembly centered in the hole. A pad, typically referred to as a wear pad or kick pad, is frequently deployed at or near the outer side of the bend angle of the transmission housing. In many instances, an additional stabilizer is mounted at or near the proximate end of the motor housing. The stabilizer or stabilizers are typically ⅛" to ¼" undersized in diameter compared to the nominal drill bit diameter and are typically concentric with the outer diameter of the component to which they are mounted.

The theoretical build rate of a bent housing motor assembly in slide mode (described further below) is determined by a "three point curvature" calculation where nominally the bit face and gauge intersection is the first point, the bend/kick pad is the second point, and the motor top or motor top stabilizer is the third point. These points work in unison to provide the fulcrum to drive the bit in the desired direction. The distance from the bit face/gauge intersection to the bend/kick pad is an aspect of the calculation. A goal of directional PDM design has been to reduce this distance because doing so theoretically enables the system to build angle at a higher rate for a given bend angle. It is important to note that three point calculations are performed on the outer bend side of the assembly, nominally operating on the "low side" of the hole. Traditional three point calculations do not take into account tool interaction with and resultant stresses engendered by contact, or over contact with the "high side" of the hole on the scribe side of the assembly. This oversight is most readily apparent at the intersection of an assembly top stabilizer with the high side of the borehole wall in sliding mode. In sliding mode, the stabilizers of the prior art actively resist the intended curvature of the hole. As will be seen, a the interaction of the outer components of the PDM with the borehole wall is an aspect taken into consideration with the method and apparatus of the technology of the present application.

The directional driller employing a bent housing PDM directs the rig to rotate the drill string including the bottom hole assembly when he feels, based on surveys or measurement while drilling information, that the well trajectory is on plan. This is called rotary mode. It produces a relatively "straight" wellbore section. It should be noted that throughout this application, where a roary drilled section is referred to as generally straight that the description includes sections that are not absolutely straight, because rotary drilled section may for example, build, drop, dip, or walk. The rotary drilled wellbore sections are generally straight in relation to the curved sections made in slide mode drilling.

When the directional surveys indicate that the well path is not proceeding at the correct inclination or azimuthal direction the directional driller makes a correction run. He has the assembly lifted off bottom and then slowly rotated until an alignment mark at surface indicates to him that the bend angle has the bit aimed correctly for the correction run. The rotary table is then locked so that the drill string remains in a position where the bend angle (tool face) is aimed in the direction needed to correct the trajectory of the well path. As drilling fluid is pumped through the drill string, the rotor of the power section turns and rotates the drill bit. The weight on the bottom hole assembly pushes the drill bit forward along the directed path. The drill string slides along behind the bit. This is called "sliding" mode and is the steering component of the well drilling process. Once the directional driller calculates that an adequate course change has been made, he will direct the rig to resume rotating the drill string to drill ahead on the new path.

Reference is made to U.S. Pat. No. 4,729,438 to Walker et al which describes the directional drilling process utilizing a bent housing PDM, which is incorporated herein by reference In its entirety as if set out in full.

The efficiency, predictability, and performance of bent housing PDM assemblies are negatively impacted by a number of factors. As noted by Walker et. al., the components of a steerable PDM can hang-up in the borehole when the change is made from rotary mode to slide drilling. This can happen as the assembly is lifted for orientation and again when the assembly is slid forward in sliding mode with the rotary locked. The hang-up can require the application of excess weight to the assembly risking damage when the hang up is overcome and the assembly strikes the hole bottom. The hang-up condition can occur not only at the location of the stabilizing members attached to the PDM, but also at the location of any of the string stabilizers above the motor as they pass through curved sections of well bore.

When rotation of the drill string is stopped to drill ahead in sliding mode, the directional driller needs to be confident that the bend in the PDM has the bit pointed in the proper direction. This is known as "tool face orientation". To make an efficient course change the tool face orientation needs to be known so the assembly can be aimed in the desired direction, otherwise the resultant section of drilling may be significantly off of the desired course. The directional driller's ability to know the tool face orientation is negatively impacted by torque and drag that result from over engagement of the drill string, and especially the stabilizers, with the borehole wall during rotary mode. It also can be altered by excess weight being applied to push the assembly ahead when it is hung up. When the assembly breaks free, the bit face can be overly engaged with the rock face, over torqueing the system, and altering the tool face orientation.

Correction runs made at an improper tool face orientation take the well path further off course, requiring additional correction runs and increasing the total well bore tortuosity adding to torque and drag.

These problems are exacerbated in assemblies that use a high bend angle. Creating a well bore with a higher amount of DLS increases the amount of torque and drag acting on the drill string and bottom hole assembly. A highly tortuous well bore brings the stabilizers into even greater contact and over engagement with the borehole wall.

It is also frequently found that the amount of curvature actually achieved in slide mode by an assembly with a given bend angle is less than was predicted by the three point calculation. This causes drillers to select even higher bend angles to try to achieve a targeted build rate. Directional drillers may also select a higher bend angle in order to reduce the distance required to make a course correction allowing for longer high penetration rate rotary mode drilling sections. This overcompensation in build approach increases the overall average penetration rate while drilling the well but it also produces a problematic, excessively tortuous wellbore.

Higher bend angles put increased stress on the outer periphery of the drill bit, on the motor's bearing package, on the rotor and stator inside the motor, on the transmission housing, and on the motor housing itself. This increased stress increases the occurrence of component failures downhole. The connections between the various housings of the PDM are especially vulnerable to failures brought on by high levels of flexing and stress.

For these and additional reasons which will become apparent, a better approach to PDM geometry and configuration is needed. The present invention sets out improved technology to overcome many of the deficiencies of the prior art.

Reference is made to IADC/SPE 151248 "Directional Drilling Tests in Concrete Blocks Yield Precise Measurements of Borehole Position and Quality". In these tests it was found that a PDM assembly with a 1.41° bend produced a 20 mm to 40 mm "lip" on the low side of the hole when transition was made from rotary to slide mode drilling in a pure build (0° scribe) section. A comparable disconformity was created on the high side of the hole in the transition from slide to rotary mode drilling. These lips can account for some of the "hang-up" experience in these transitions. IADC/SPE 151248 is incorporated by reference in its entirety.

Reference is also made to the proposed use of eccentric stabilizers in directional drilling, either in non-rotating configurations, or on steerable PDMs as a biasing means, alone or in conjunction and alignment with a bent housing. A specific reference in this area of art is the aforementioned Walker reference. Additional references include U.S. Pat. Nos. 2,919,897; 3,561,549; and 4,465,147 all of which are incorporated by reference in their entirety.

Reference is also made to U.S. patent application Ser. No. 15/430,254, filed Feb. 10, 2017, titled "Drilling Machine", which is incorporated herein by reference as if set out in full, which describes, among other things, a Cutter Integrated Mandrel (CIM). The CIM technology may be advantageously employed in connection with the current technology. In addition the Dynamic Lateral Pad (DLP) technology of the referenced application may also be advantageously employed in connection with the current technology. The "Drilling Machine" application is assigned to the same assignee as the current invention and is incorporated by reference in its entirety.

The guidance positioning technology of present application can also be mounted on adjustable diameter mechanisms such as are used on Adjustable Gauge Stabilizers, as are known in the art. A non-limiting example is U.S. Pat. No. 4,848,490 to Anderson which is incorporated by reference in its entirety.

SUMMARY

The technology of the present application discloses a new method of analyzing bent housing PDM directional drilling assemblies operating in and interacting with curved and generally straight hole wellbores. Employing this method allows for the creation of novel non-stabilizer guidance positioning members (generically referred to as positioners such as, for example, the upper positioner or the near bit positioner) that can replace traditional near bit stabilizer and upper stabilizer components on a directional PDM assembly. The new method may also replace a traditional kick/wear pad on a directional PDM assembly. The method is also applicable to analyzing and replacing traditional string stabilizers with guidance positioning technology. In part the technology of the present application is based on the observation that traditional 3 point calculations and BHA modeling fail to take into account the complete set of geometries of a steerable system operating in a curved well bore. By modeling a steerable PDM assembly in both sliding and rotary mode, the technology of the present application defines guidance positioning assemblies that replace traditional centralizing/stabilizing assemblies of the prior art.

These novel assemblies generated by the method steps have a contoured axially and circumferentially asymmetric eccentric outer shape which provides the needed support for the steering fulcrum effect while minimizing the production of torque, drag, and hang-up such as is attendant in the prior art. In some embodiments, the asymmetric and/or eccentric shapes provide for positioners in which different changing cross sectional views of the positioner are different so that a first cross sectional view along a first diameter of the positioner is different than every other cross sectional view taken along any other second diameter different from the first diameter. In other words, the positioners have a plurality of cross sectional views wherein each of the cross sectional views has different dimensions. The new assemblies are designed to accommodate the fit of the directional drilling assembly in a curved wellbore section in sliding mode and a generally straight wellbore in rotary mode. Unlike traditional stabilizers which attempt to force the assembly to the center of the hole, an unnatural condition when utilizing a bent housing, the new assemblies provide appropriate fulcrum points in the sliding mode and act to keep the housing itself off of the hole wall in rotary mode, while mitigating the stresses produced by the prior art technologies. The assembly is capable of drifting the wellbore for which it is designed, in either sliding or rotary mode drilling, while significantly mitigating deflection stress on the assembly and housings. Guidance positioners provide a neutral support of the directional assembly. This is a capability not achieved by traditional directional PDM assemblies utilizing stabilizers.

As a first method step, the system designer models in two dimensions a directional drilling assembly of a given bit diameter, bend angle, bit to bend length, distance to the top of the assembly above the power section, and expected well bore curvature. As part of this first step, the system designer identifies the bit contact zone, the bend contact zone and the assembly top contact zone. In addition, the system designer may identify candidate contact zones on the bearing housing, on the transmission housing above the bend angle, or along the body of the power section housing at his discretion.

As a second method step, the system designer builds a three dimensional model of the assembly in the curved hole, as would be drilled in sliding mode, and places on it "mock" members at each non-bit proposed contact zone. Each of these mock members is given a diameter sufficient to allow for the removal of "stock" later in the analysis. This diameter is typically near the bit diameter. The system designer also selects a length for each of the mock members typically longer than 6 inches and shorter than 7 feet. During the process of the method the mock members will be modified to become modeled guidance positioners.

As a third method step, the system designer models the interaction of the mock members with the borehole wall in one of the drilling modes, slide drilling mode (sometimes referred to as sliding mode or slide mode) or rotary drilling mode (sometimes referred to as rotating drilling mode or rotary mode). The designer may start with either drilling mode but for the purposes of this description sliding mode is chosen. The initial drilling mode may be referred to as the first drilling mode in certain embodiments. In sliding mode, the system designer removes stock from each of the mock members where the mock member body falls outside of the modeled curved wellbore wall. This stock removal can be readily accomplished in commercially available CAD programs through a function which checks for interference and then trims the unwanted stock beyond the interference.

As a fourth method step, the system designer models the interaction of the mock members with the borehole wall in the alternate drilling mode, in this instance in the rotary mode. The subsequent model may be referred to as the second drilling mode in certain embodiments. In this model, the system designer again removes stock from each of the mock members. In this instance, it is where the mock member body falls outside of the modeled generally straight hole wellbore wall created in rotary mode. In certain aspects, the rotary drilling mode modeling and modification step (below) may be optional.

As a fifth method step, the system designer determines, at his discretion, the number of "flutes" or fluid passageways he wants on each guidance positioner that has been developed in the preceding steps. The width, depth, spiral or lack thereof, and circumferential location of each of the flutes is also at the system designer's discretion. The positioning of the flutes will contribute to the resultant geometry of the blades of each of the guidance positioners. These types of discretionary choices of the fifth method step are well known to those skilled in the art of stabilizer design.

As a sixth step, the system designer removes by blending any "proud" material that was not removed in the third, fourth, and fifth method steps. This step may also include removing, at the system designer's discretion, any remaining blade structures that fail to ever come into contact with the borehole wall in both slide and rotary drilling. As a practical matter these unnecessary blades are most likely to fall on the scribe side of a guidance positioner located on the bearing housing very near the bit. In completing the sixth step, the system designer may determine to reduce the outer profile of the remaining guidance positioner material in anticipation of building back out to the desired profiles as identified in the modeling steps using the processes described herein, including, for example, the next step.

As a seventh step, the system designer designates wear protection for the guidance positioners. This can be hard facing, tungsten carbide inserts, or polycrystalline diamond inserts or any combination thereof. These protections are given by way of example only. Any wear protection method as known in the art can be used in any combination to harden and protect the wear surfaces of the guidance positioners. In one aspect, where more than the modeled profile material has been removed from the positioner blades (as referred to above), protection means, most notably tungsten carbide or PDC (inserts or domes), may be press fit, brazed, or otherwise attached to the guidance positioner at exposures above the surface of the positioner body, to build back out substantially to the modeled profile. This building back out can be accomplished with welding, brazing of tungsten carbide tiles, or other methods as are known in the art.

It is noted that wear protection on the guidance positioners is less critical than on traditional stabilizers since the guidance positioners contact with the borehole wall has been designed to be less aggressive than traditional stabilizers. This is the case because each of the guidance positioners are designed to smoothly engage the borehole wall at their specific position relative to the bend of the bent housing. At discretion of the system designer, additionally polycrystalline diamond compact (PDC) or tungsten carbide cutters may be deployed on the distal surfaces of either the slide drilling mode defined blades or the rotary drilling mode defined blades, or both. These cutters may be deployed in any orientation as is known in the art, to cut in shear in rotary mode, or to plow in sliding mode. The purpose of these cutters is to better enable the guidance positioner members to address transiting the transition lips identified in IADC/SPE 151248 referenced above. Although PDC or tungsten carbide cutters have been noted here, any suitable cutting element known in the art may be deployed for this purpose.

The system designer can choose the number of flutes and method of wear protection at any stage, even before starting the modeling process.

As a final step, the system designer produces the computer machining files needed to machine or fabricate by subtractive or additive manufacturing techniques the designed guidance positioners that will be deployed on the Bottom Hole Assembly or drill string. This description is not meant to limit the manufacturing techniques that may be chosen to create the guidance positioners of the invention. Any manufacturing method, including welding, grinding, turning, milling, or casting or any other method known in the art may be used.

At his discretion, the system designer may axially distance the slide drilling mode section of a guidance positioner set from the rotary drilling mode section of a guidance positioner set. This can be accomplished by creating a longer mock member, modeling the outer configuration in one of the drilling modes and then the other drilling mode. The distal section of the resultant guidance positioner set can then for instance retain only the slide mode outer configuration, eliminating the remainder of the member on the opposing side of the positioner. The proximal section of the guidance positioner set can then retain only the rotary mode outer configuration, eliminating the opposing slide mode configuration. The resulting guidance positioner set then may have one, two, or three slide mode blades located on one side of the housing and one, two, or three rotary mode blades located on the opposite of the housing and at a different axial location.

Alternatively, the designer may place two mock members axially distanced from each other and model the distal mock member as slide mode positioner and the more proximal mock member as a rotary mode positioner. By taking this approach, the designer eliminates the steps of creating and then removing mock material in the axial length between the final slide mode positioner and the final rotary mode positioner of a guidance positioner set.

At least one advantage of this approach, axially distancing the slide mode positioner of a set from the rotary mode positioner of a set, is that the flow area for cuttings and fluid is greater in cross section at either of these locations than would be the case if the slide mode and rotary mode blades were located at the same general axial location on the assembly.

For the purposes of this method the designer can use a CAD/CAM design software such as AutoCAD, Pro Engineer, Solid Works, Solid Edge or any other commercially available engineering 3D CAD/CAM system. As noted earlier the interference and trim function of the CAD system may be employed to determine the outer configuration of the guidance positioners.

The development of the above design method was made by the inventors of the present technology observing that traditional near gauge stabilizers unnaturally force the assembly towards the center of the hole. This unnatural positioning of the drilling assembly causes the assembly to disadvantageously push the prior art stabilizers into over engagement with the bore hole wall, damaging and enlarging the wall and creating accelerated wear on the stabilizers. By forcing the assembly into an unnatural position, increased stress and load is placed on the housings of the assembly increasing the likelihood of fatigue failure. It also adds significantly to the problems of drag in sliding mode and torque and drag in rotary mode.

One prior art solution to the problems attendant to stabilized directional PDM assemblies has been to run the assembly "slick", that is with only a kick pad and no other stabilization. Although this solution overcomes the problem of stabilizer over engagement it fails as an effective directional assembly. Slick assemblies are thought to offer no resistance to the effects of bit torque, housing drag on the wellbore, and are far more likely to present tool face orientation problems.

An additional challenge posed by the stabilizers of the prior art is their failure to conform to the curvature of a curved well bore section. If the outer surfaces of a PDM stabilizer or kick pad are axially linear then the actual point of contact at any given stage of slide drilling can shift from the distal end to the proximate end and back, altering the actual performance of the fulcrum effect in steering. The same challenge is somewhat addressed by curved stabilizer outer surfaces, but if the curve is not custom fitted to the build rate curvature of the wellbore, then point loading can occur leading to keyseating. The guidance positioners of the technology of the present application set out to achieve a surface contact of the outer surfaces in the sliding mode such that the curve is more fitted to the build rate curvature.

Yet another deficiency that the inventors have observed with directional PDM assemblies of the prior art is their failure to build angle at the expected rate when making the initial build from vertical. This can be explained, in part, by the fact that the top stabilizer on the upper housing of the PDM remains in the vertical section when the build begins. This stabilizer centers or nearly centers the top of the assembly in the vertical hole, altering the fulcrum effect and reducing the action of the bend on the bit. The guidance positioners of the technology of the present application allow for an improved positioning angle of attack when making the initial build from vertical, mitigating this problem with the prior art.

Yet another observation made during the development of this technology is that in at least some, and potentially many, instances additional contact may occur on the high side of the assembly in slide mode. It has been observed that this high side contact can move during the slide due to deflection and may occur at various times from the upper end of the transmission housing to points all up and down the motor housing. These shifting high side contact points can dramatically and unpredictably alter the build characteristics of the assembly. To address this condition, the system designer employing the technology of the present application may place a slide mode configured guidance positioner or high side kick/wear pad on the high side of the assembly to limit the high side contact to a single, predictable and calculable point. This approach mitigates the shifting high side contact observed in the modeling described in the present application.

By performing the method steps, a circumferentially and axially asymmetric eccentric configuration of each guidance member results. This modeling defined circumferential and axial asymmetric eccentricity is aligned to the bend to provide the appropriate fulcrum effect for steering in sliding mode. It also provides an appropriate configuration to substantially hold the body of the directional drilling assembly off of the wellbore wall in both sliding and rotary drilling modes without bringing about over engagement of the guidance members with wellbore wall. An attribute of the modeling defined configuration is that each of the guidance positioning member blades has a slightly axially curved outer surface that conforms to the curve of the curved section of the wellbore. Another attribute of the guidance positioners of the technology of the present application is that multiple axially taken cross-sections of any guidance poisoner blade will vary in shape and area each from the other. This is a result of the wellbore conforming axial and peripheral curves of the rotary and slide drilling outer surfaces which produce the circumferential and axial asymmetric eccentricity.

From the previous discussion, it can be seen that an embodiment of the technology of the present application may have a distal slide mode only guidance positioner member opposite the scribe side of the assembly, a more proximal and axially distanced rotary mode only guidance positioner in the same set on the same side of the assembly as the scribe, and an even more proximally located guidance positioner member, with both slide mode and rotary mode blades or only slide mode blades, in the same general axial location where the slide mode blades are on the same side of the assembly as the scribe and the rotary mode blades, if any, are on the side of the assembly opposite the scribe.

The same design process may be applied to create guidance positioning members which then can replace traditional string stabilizers or stabilizers deployed on other bottom hole assembly (BHA) devices such as measurement while drilling or logging while drilling tools. These new guidance positioning members are aligned to the bend angle of the motor and reduce the likelihood of hang-up that can occur at locations on the drill string or BHA as they pass through curved wellbore sections in rotary mode and especially in sliding mode.

The technology is also applicable to combined RSS Motor systems.

It is an object of the technology of the present application to create smoother wellbores. This includes smoother build sections and less tortuous horizontal sections.

It is an object of the technology of the present application to improve the effectiveness of bend elements in directional PDM assemblies, allowing for the use of less aggressive bend angles to achieve a given build rate. Using a less aggressive bend angle reduces the amount of hole oversize created in the rotate drilling mode, reducing operational costs. Using a less aggressive bend angle reduces the loads and stresses on the outer periphery of drill bits used in directional drilling PDM assemblies, improving the life and performance of the bits. Employing the current technology with the Cutter Integrated Mandrel technology referred to above allows for even less aggressive bend angles for a given build rate.

It is an object of the technology of the present application to produce directional wellbores requiring fewer correction runs.

It is an object of the technology of the present application to reduce torque and drag generated by the interaction of a directional PDM assembly with the wellbore.

It is an object of the technology of the present application to allow for longer lateral sections to be drilled through the reduction in tortuosity, torque, and drag resulting from the use of the technology.

It is an object of the technology of the present application to increase the flow path for drilling fluid and cuttings past the outer members of a directional PDM assembly.

It is an object of the technology of the present application to increase rate of penetration in drilling operations utilizing directional PDM assemblies. This is accomplished by increasing the ratio of rotary drilling mode to sliding drilling mode and by making the drilling occurring in rotary mode and especially in slide drilling mode more effective.

It is an object of the technology of the present application to improve the predictability and certainty of tool face orientation reducing the number and length of correction runs required for a given directional well.

It is an object of the technology of the present application to reduce the amount of stress, deflection, and load placed on the various housings of a directional drilling PDM assembly.

It is an object of the technology of the present application to reduce the wear rate on bits used on directional drilling assemblies by allowing for less aggressive bend angles.

It is an object of the technology of the present application to provide appropriate support, guidance, and fulcrum effect to a directional drilling PDM assembly rather than detrimental centralization or stabilization of the prior art.

It is an object of one embodiment of the technology of the present application to reduce in size and more effectively transit the transition lips existing in directional wellbores at the transition from rotary to slide mode drilling and from slide mode to rotary drilling.

It is an object of the technology of the present application to allow for even higher build rates than traditional directional drilling PDM assemblies.

It is an object of the technology of the present application to provide improved performance of Rotary Steerable Systems that utilize PDM motors.

It is an object of the technology of the present application to provide guidance positioning members that can replace traditional stabilizers utilized on other BHA components or on drill string.

BRIEF DESCRIPTION OF THE DRAWINGS

FIG. 11A shows mock members placed on selected locations on a directional drilling assembly in a curved wellbore.

FIG. 11B shows a modified version of the same directional drilling assembly with the mock members now reflecting an initial stock removal determined from the interference of the mock members with the curved wellbore wall in sliding mode.

FIG. 11C shows the modified version of the directional drilling assembly now deployed in a straight wellbore.

FIG. 11D shows the modified version of the directional drilling assembly deployed in straight wellbore with further stock removed from the previously partially modified mock members.

DETAILED DESCRIPTION

Figure 1:
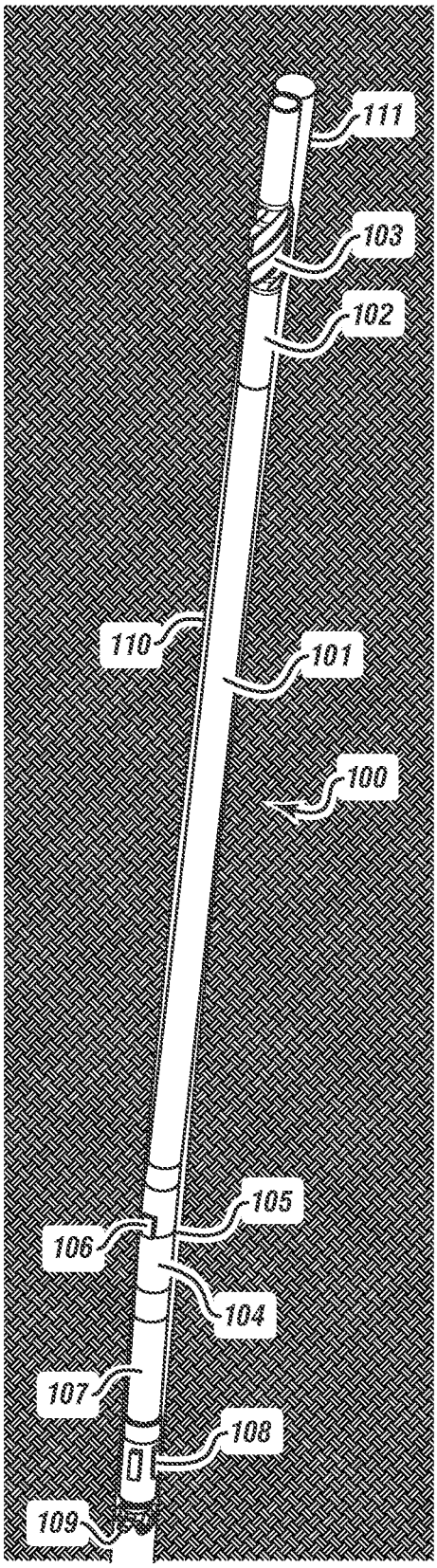
FIG. 1 shows a side view of a prior art steerable PDM drilling in sliding mode in a curved well bore.

FIG. 1 shows a side view of a prior art steerable PDM 100 drilling in sliding mode in a curved wellbore 110. The system includes power section 101, upper bypass valve and rotor catch section 102 fitted with upper stabilizer 103, transmission housing 104, bend 105, kick pad 106, bearing housing 107, lower stabilizer 108, and bit 109. The top of the curved wellbore section is shown at 111. The curved wellbore 110 shown is representative of approximately a 12 degree per 100 feet curvature. The bend 105 shown is representative of a 1.75 degree bend angle. The curvature rate and bend angle shown are for illustrative purposes for this example. The method and apparatus of the invention are equally applicable to any bend angle and resultant curvature rate.

Figure 2:
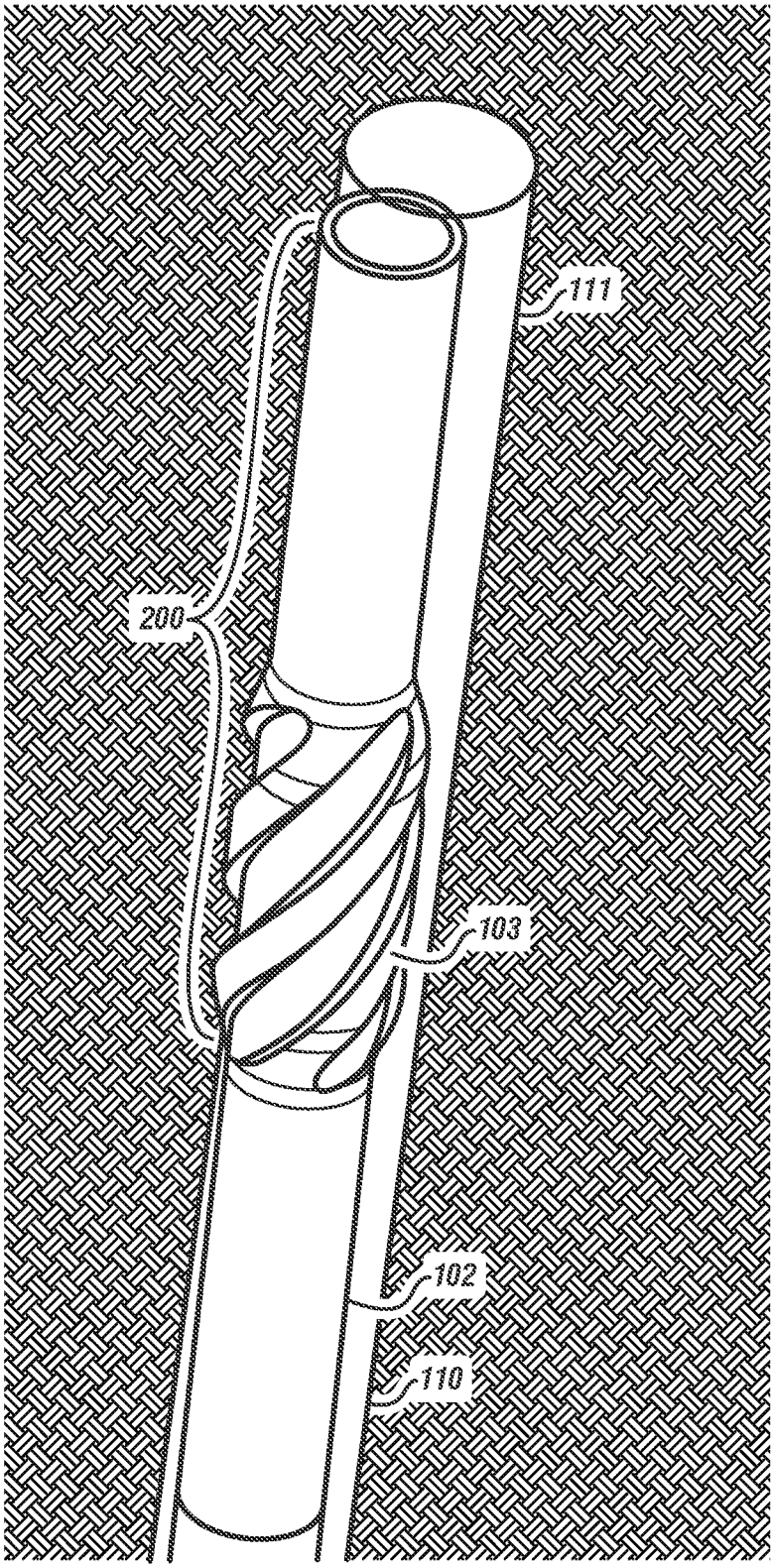
FIG. 2 shows a detail of the proximate stabilizer of a prior art steerable PDM over engaging the well bore while drilling in sliding mode.

FIG. 2 shows a detail of the proximate stabilizer of a prior art steerable PDM over engaging the wellbore wall while drilling in sliding mode. Upper stabilizer 103 and upper part of bypass valve and rotor catch section 102 are shown to be in over engagement with the top of curved wellbore 111 generally at section 200 of curved wellbore 110. In this sliding mode view the over engagement area at 200 is on the "low side" of the curved wellbore 110. As drilling proceeds in sliding mode the competency of the rock (not shown) resists the over engagement of the upper stabilizer 103 and the upper bypass valve and rotor catch section 102. This resistance creates drag and also flexes the upper part of the full assembly 100 back towards the center of the hole. Because the amount of deflection relative to the amount of over engagement 200 is unknown to the directional driller at surface the actual curvature of the assembly 100 is unknown and therefore its performance in building angle is unpredictable. It should be noted that prior art lower stabilizer 108 in FIG. 1 also demonstrates an over engagement with the borehole wall in sliding mode drilling.

Figure 3:
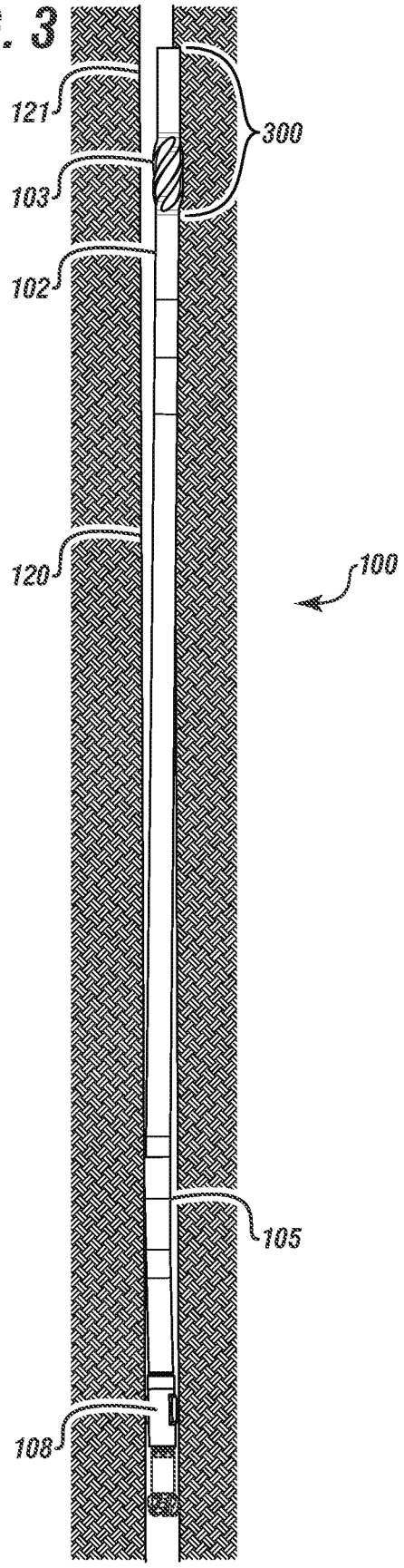
FIG. 3 shows a side view of a prior art steerable PDM drilling in rotary mode in a straight well bore.

FIG. 3 shows a side view of a prior art steerable PDM 100 drilling in rotary mode in a straight wellbore 120. In this view upper stabilizer 103, and upper part of bypass valve and rotor catch section 102 are shown to be in over engagement with the top of straight wellbore 121 generally at section 300 of straight wellbore 120. In this rotary drilling mode view the over engagement area at 300 is on the "high side" of the straight wellbore 120. In rotary mode drilling the over engagement area at 300 will cycle around the hole with each rotation. In this view lower stabilizer 108 in FIG. 3 also demonstrates an over engagement with the borehole wall. The over engagement area at lower stabilizer 108 will also cycle around the hole with each rotation. Torque and drag resulting from the over engagement of the prior art stabilizers with the borehole wall in rotary mode drilling will alter the "tool face orientation" by an unknown amount when the directional driller needs to make a correction run in sliding mode.

Figure 4A:
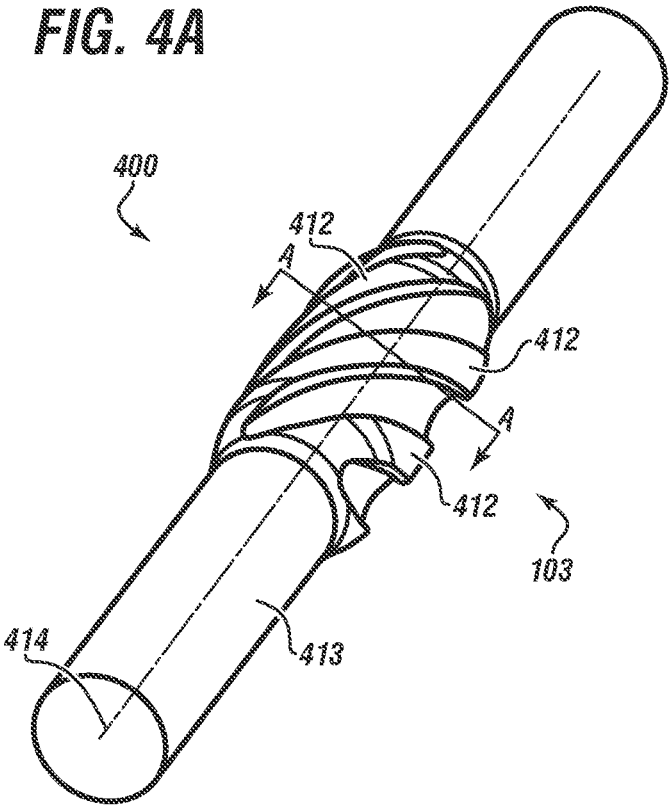
FIG. 4A shows an isometric view of a prior art stabilizer as would be deployed on a prior art steerable PDM.

FIG. 4A shows an isometric view 400 of a prior art stabilizer 103. In this view significant portions of three of the four blades of the stabilizer can be seen. These are noted at 412. The stabilizer is mounted on a representative housing 413 which could be a PDM bearing housing, or an upper power section housing, or a bypass valve/rotor catch housing, or a string component higher up the hole from the PDM. Stabilizer 103 and representative housing 413 are concentric and share centerline 414.

Figure 4B:
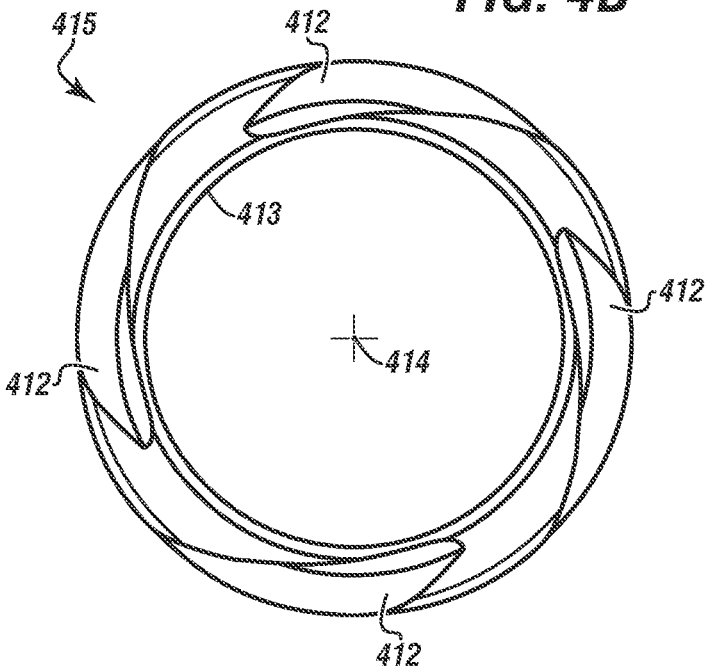
FIG. 4B shows a cross-section view of the prior art stabilizer of FIG. 4A.

FIG. 4B shows a cross section 415 of prior art stabilizer 103 taken across A-A on FIG. 4A. It can be seen in both FIG. 4A and FIG. 4B that blades 412 are equally spaced from each other around the outer perimeter of the stabilizer. This blade configuration may be referred to as blade symmetry. It can also be seen that the outer diameter of the blades 412 is concentric with the diameter of the housing 413 and that the stabilizer and the housing share centerline 414. This aspect of this type of prior art stabilizer may be referred to as concentricity.

Figure 5A:
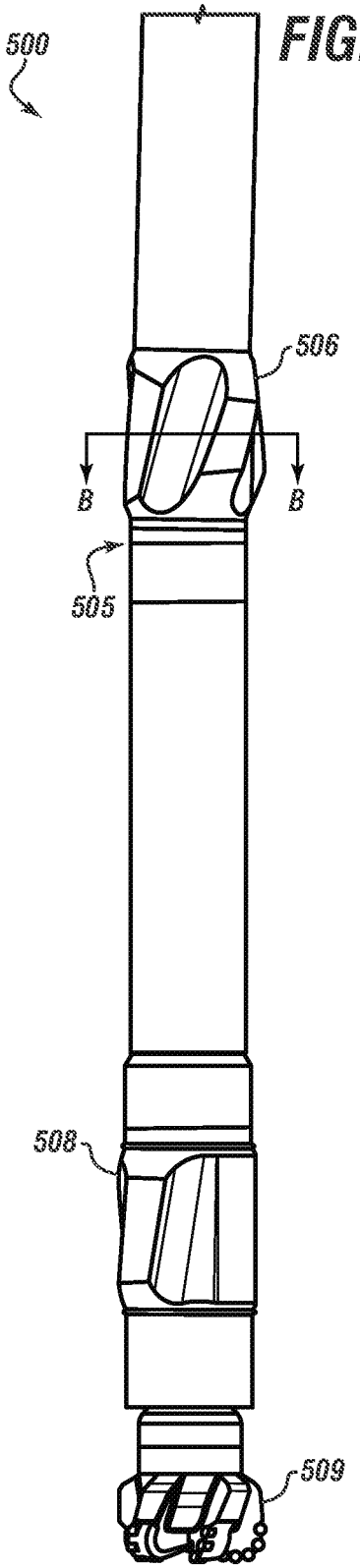
FIG. 5A shows a side view of a lower directional PDM section employing guidance positioning members consistent with the technology of the present application.

FIG. 5A shows a side view 500 of a lower directional PDM section employing guidance positioning members consistent with the technology of the present application. At the distal end of assembly 500 is a typical drill bit 509. A near bit guidance positioner is shown at 508. In this instance, guidance positioner 508 is located on the bearing housing in approximately the same axial position as a prior art near bit stabilizer could be. In this instance guidance positioner 506 is located in approximately the same axial position as a prior art kick/wear pad would be. In this view the bend angle is shown at 505. This assembly is configured to employ an upper assembly guidance positioner (not shown).

Figure 5B:
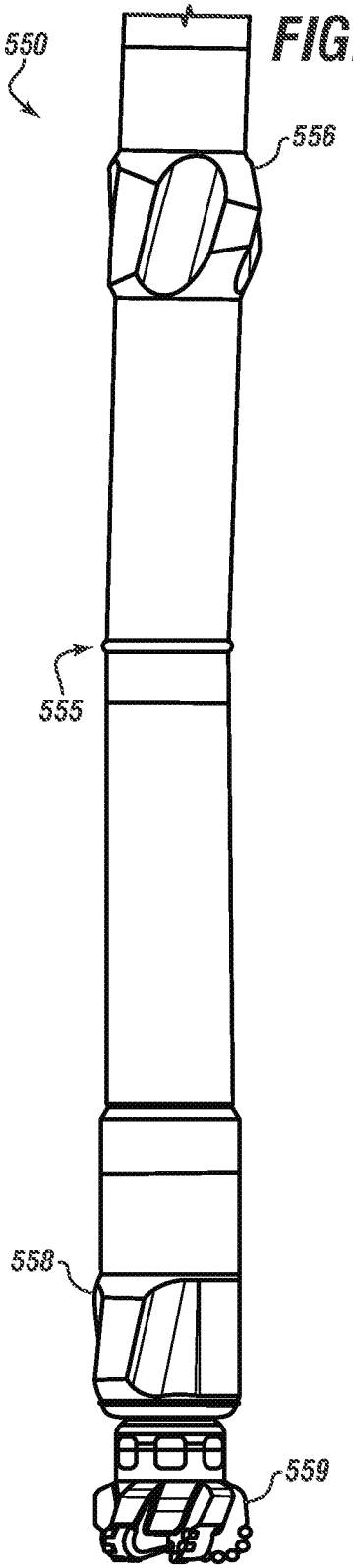
FIG. 5B shows a side view of an alternative embodiment of a lower directional PDM section employing guidance positioning members consistent with the technology of the present application.

FIG. 5B shows a side view 550 of an alternative embodiment of a lower directional PDM section employing guidance positioning members consistent with the technology of the present application. At the distal end of assembly 550 is a typical drill bit 559. A near bit guidance positioner is shown at 558. In this instance guidance, positioner 558 is located on the most distal end of the bearing housing. In this instance, guidance positioner 556 is located well above the bend angle and well above where a prior art kick/wear pad would be. In this view the bend angle is shown at 555. This assembly is configured to not employ an upper assembly guidance positioner but rather to be run "slick" above the guidance positioner at 556. This configuration shortens the distance between the three points of the calculation and provides for a stiffer fulcrum effect which can improve performance and allow for a smaller bend angle to achieve a given build rate.

Figure 6A:
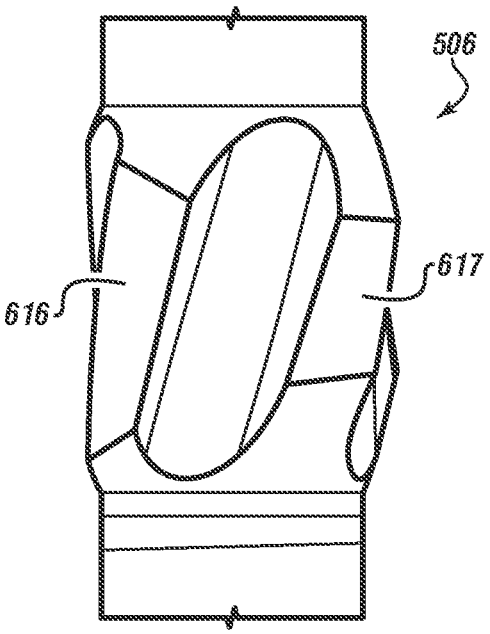
FIG. 6A shows a side view of a guidance positioning member consistent with the technology of the present application.

FIG. 6A shows a detailed side view of the guidance positioner 506. This view is in the same orientation as is shown for 506 in FIG. 5A. Blade 616 shown to the left of FIG. 6A is one that has been defined by stock removed in the rotating mode analysis. Blade 617 on the right hand side of FIG. 6A is one that has been defined by stock removed in the sliding mode analysis.

Figure 6B:
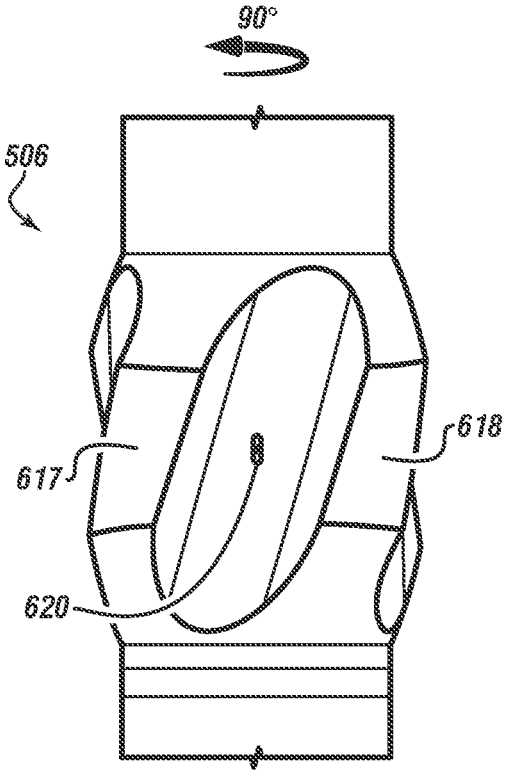
FIG. 6B shows a detailed side view of the guidance positioner of FIG. 6A rotated 90° from the position shown in FIG. 6A.

FIG. 6B shows a detailed side view of the guidance positioner 506 rotated ° from the position shown in FIG. 6A. Blade 617 is now to the left and blade 618 has now come into view on the right. Both blades 617 and 618 have been defined by stock removed in the sliding mode analysis. FIG. 6B also shows scribe mark 620 denoting the scribe side of the tool.

Figure 6C:
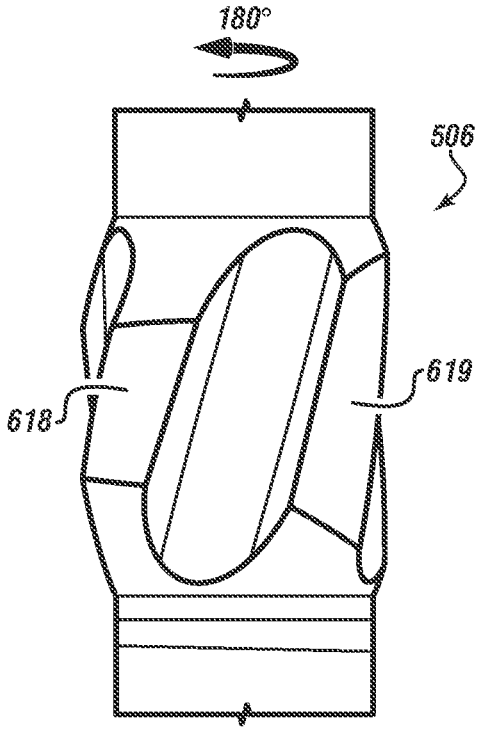
FIG. 6C shows a detailed side view of the guidance positioner of FIG. 6A rotated 180° from the position shown in FIG. 6A.

FIG. 6C shows a detailed side view of the guidance positioner 506 rotated 180° from the position shown in FIG. 6A. Blade 618 is now on the left and blade 619 has now come into view on the right. As noted previously blade 618 is one defined by stock removed in the sliding mode analysis. Blade 619 is one that has been defined by stock removed in the rotating mode analysis.

Figure 6D:
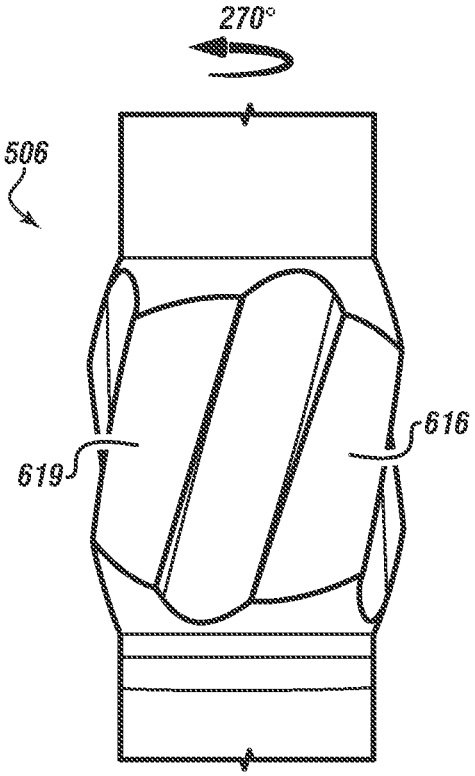
FIG. 6D shows a detailed side view of the guidance positioner of FIG. 6A rotated 270° from the position shown in FIG. 6A.

FIG. 6D shows a detailed side view of the guidance positioner 506 rotated 270° from the position shown in FIG. 6A. Blade 619 is now on the left and blade 616 has now come back into view on the right. Both blades 619 and 616 have been defined by stock removed in the rotating mode analysis It should be noted in FIG. 6A-6D that the blade geometry of blades 616, 617, 618, and 619 demonstrate a circumferentially and axially asymmetric eccentric configuration.

Figure 6E:
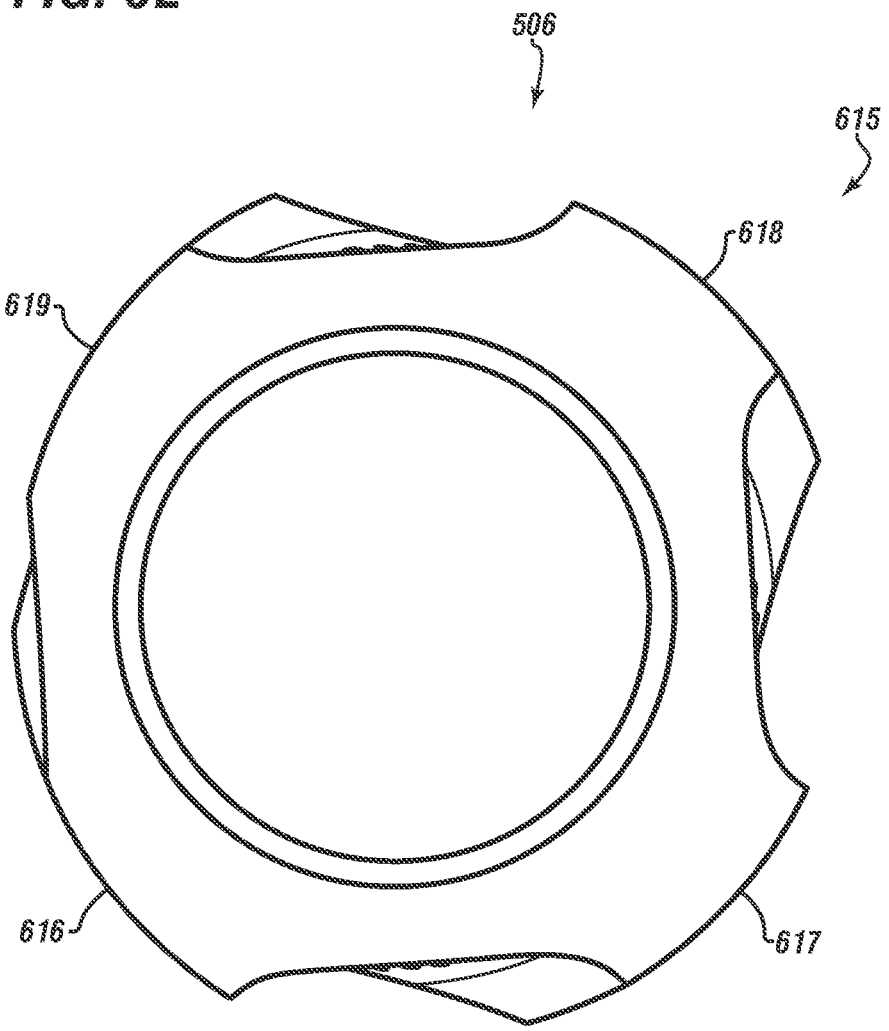
FIG. 6E shows a cross-section view of the guidance positioning member of FIG. 5.

FIG. 6E shows a cross-section view 615 of the guidance positioning member 506 of FIG. 5A. In this FIG. 6E, the two blades on the left, 616 and 619 have had their outer shape defined in the model in the rotary drilling mode. The two blades on the right, 617 and 618, have had their outer shape defined in the model in the slide drilling mode. In this view 615 of this particular guidance positioner it is clear that the rotate drilling mode defined blades 616 and 619 are shallower and wider than the slide mode defined blades 617 and 618. FIG. 6E provides another view of the circumferential asymmetric eccentricity of the guidance positioners of the invention.

Figure 7:
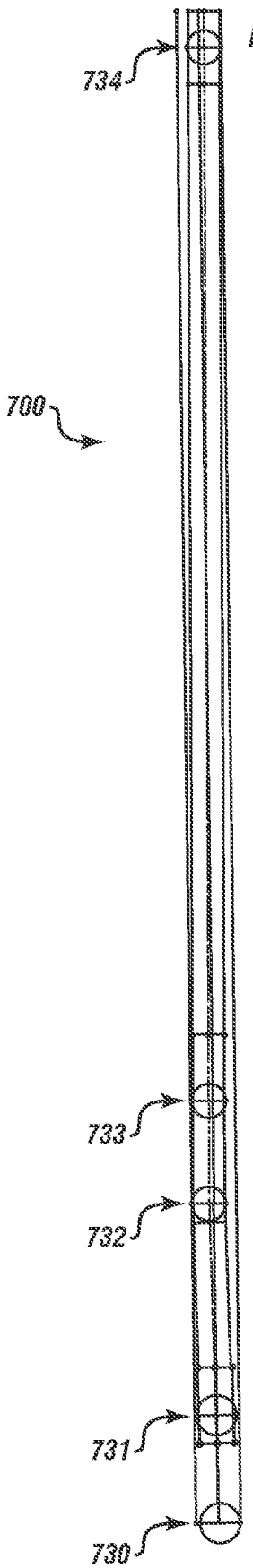
FIG. 7 is a side view of a 2D model of a directional PDM assembly in rotate drilling mode as used in the method of creating guidance positioners consistent with the technology of the present application.

FIG. 7 is a side view 700 of a 2D model of a directional PDM assembly in rotate drilling mode in a straight hole as used in the method of modeling guidance positioners of the invention. In this view, 730 denotes the drill bit contact zone in the rotate drilling mode. 731 denotes a near bit bearing housing contact zone. 732 denotes a bend angle contact zone. 733 denotes a contact zone on the transmission housing above the bend angle. Finally 734 denotes a contact zone at the top of the assembly on the by-pass valve rotor catch housing. It should be noted that in this view contact zone 734 is pushed into the "high side" of the wellbore, however since this is rotate drilling mode the location of the contact zones will rotate around the hole diameter with each rotation. In this example the nominal bit diameter being modeled is 8.75", the theoretical build rate of the assembly is 12°/100', and the theoretical wellbore diameter made in rotate drilling mode is 9.5".

Figure 8:
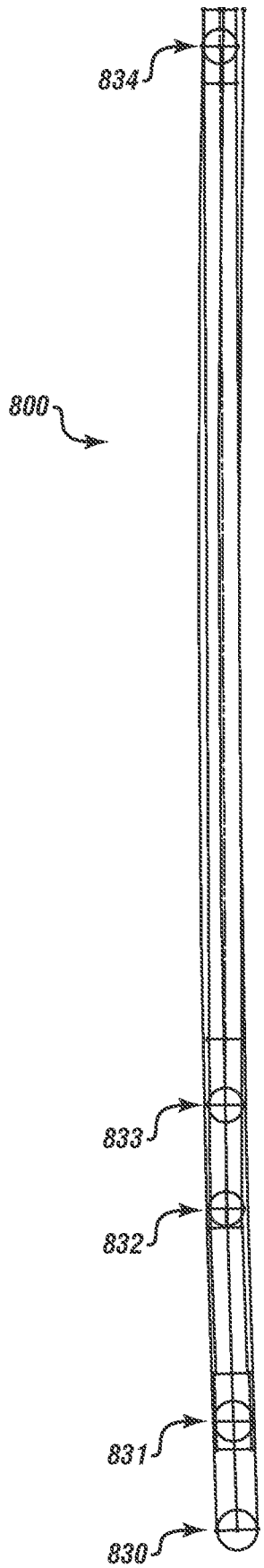
FIG. 8 is a side view of a 2D model of the same directional PDM assembly now in sliding mode as used in the method of modeling guidance positioners consistent with the technology of the present application.

FIG. 8 is a side view 800 of a 2D model of the same directional PDM assembly described in FIG. 7 now in sliding mode in a curved hole as used in the method of modeling guidance positioners of the invention. In this view 830 denotes the drill bit contact zone in sliding drilling mode. 831 denotes a near bit bearing housing contact zone. 832 denotes a bend angle contact zone. 833 denotes a contact zone on the transmission housing above the bend angle. Finally 834 denotes a contact zone at the top of the assembly on the by-pass valve rotor catch housing. It should be noted that in sliding mode contact zone 834 is pushed into the "low side" of the wellbore. Since this is sliding mode the contact zones will remain in the same orientation relative to the wellbore throughout the slide.

Figure 9:
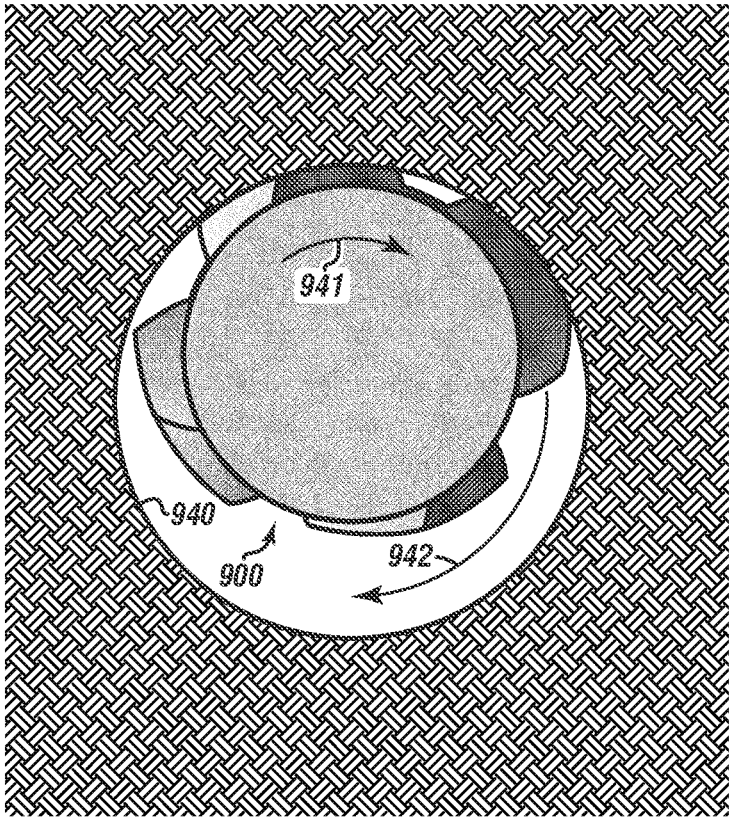
FIG. 9 shows a cross section of an upper motor housing guidance positioner deployed in a wellbore.

FIG. 9 shows a cross section of an upper motor housing guidance positioner 900 deployed in a wellbore 940. Arrow 941 shows the right hand rotation of the drill pipe. Arrow 942 shows the direction of progression around the outer circumference of the wellbore of the guidance positioner 900 in rotary drilling mode.

Figure 10:
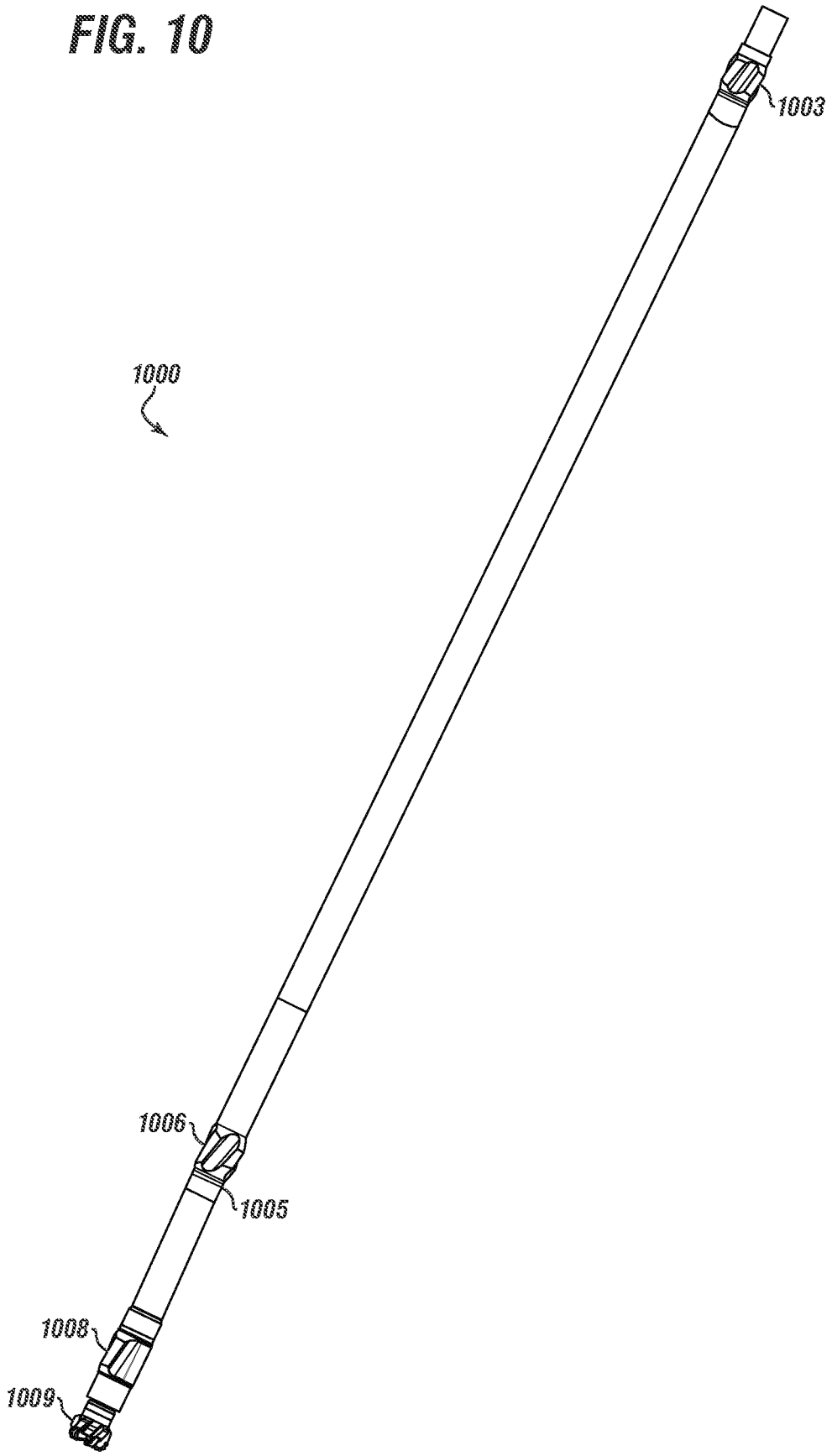
FIG. 10 shows a side view of a complete directional drilling assembly utilizing the guidance positioner technology consistent with the technology of the present application.

FIG. 10 shows a side view 1000 of a complete directional drilling assembly utilizing the guidance positioner technology of the present application. In this view 1009 denotes the drill bit, 1008 denotes a near bit guidance positioner, 1005 denotes the bend, 1006 denotes a transmission housing guidance positioner, and 1003 denotes an upper housing guidance positioner.

FIGS. 11A-11D show the progression of method steps used to configure representative guidance positioners of the technology of the present application.

Figure 11A:
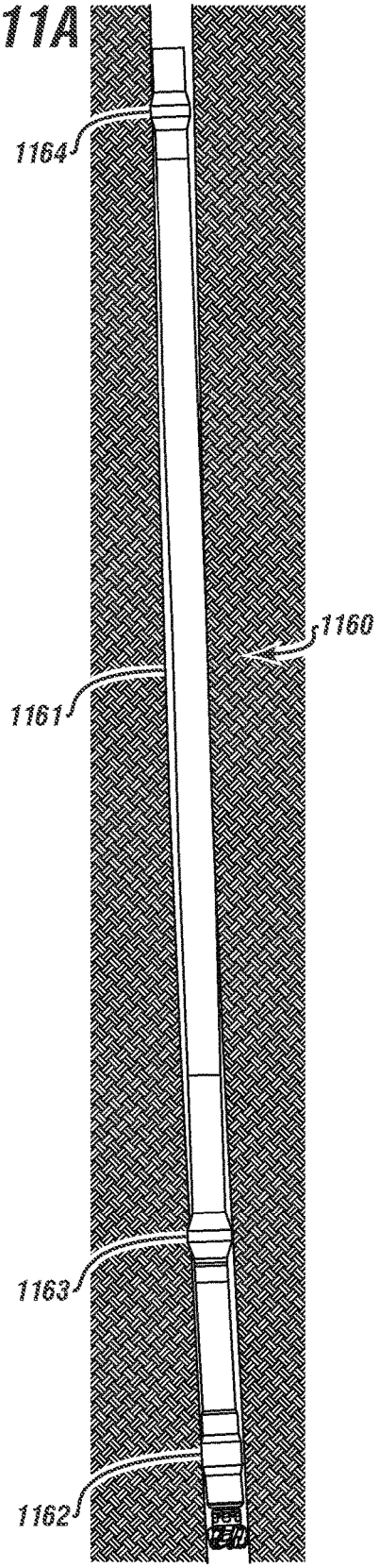
FIGS. 11A-11D show the progression of method steps used to configure representative guidance positioners consistent with the technology of the present application.

FIG. 11A shows full diameter mock members placed on three selected locations on an initial version 1160 of a directional drilling assembly in a curved wellbore 1161. The initial version 1160 may be considered an unmodified model or an unmodified directional drilling assembly. In this instance the curve of the wellbore 1161 represents a degree per 100 feet build rate. The lowermost mock member is shown on the bearing housing at 1162. At 1163 a mock member is shown on the transmission housing just above the bend angle. A final mock member is shown on the dump valve/rotor catch housing at 1164. The unmodified model 1160 is simulated in a curved wellbore section to identify over engagement contact points using a slide drilling mode, which over engagement contact points may be referred to as slide mode over engagement contact points or the like.

Figure 11B:
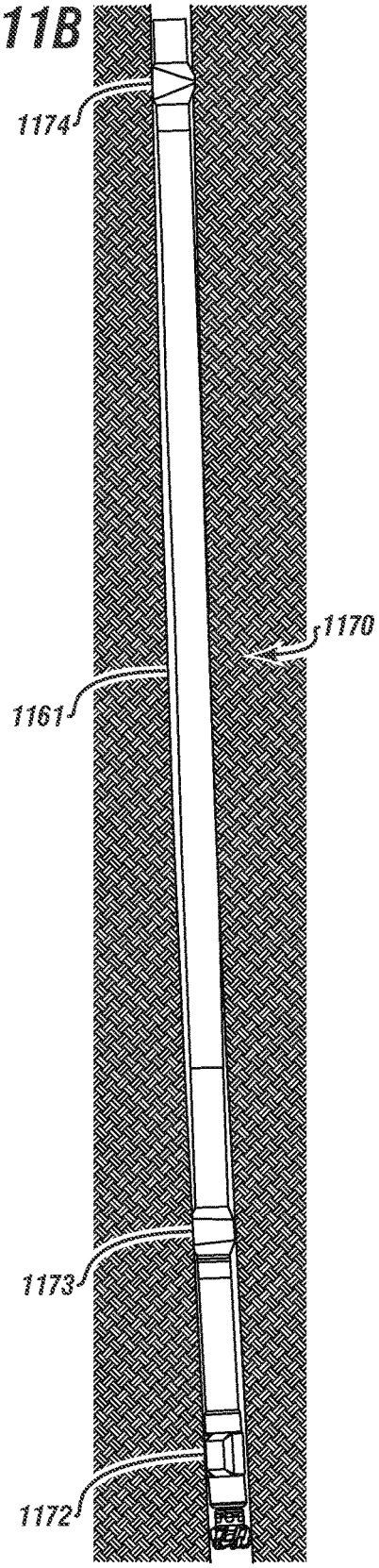

FIG. 11B shows a modified version 1170 of the same directional drilling assembly with the mock members now reflecting an initial stock removal determined from the interference of the mock members with the curved wellbore wall in sliding mode. The modified version 1170 may be referred to as a first modified model or a first modified directional drilling assembly. The generation of the model may be via a second modeling step to distinguish between the first modeling step showing the unmodified model above. The lowermost member 1172 is now in its final outer configuration with stock removed on the low side of the mock member from the slide interference analysis step and stock removed from the high side of the mock member at the system designer's discretion. Modified mock members 1173 and 1174 now show outer configurations with stock removed from the slide drilling interference analysis in curved wellbore 1161.

Figure 11C:
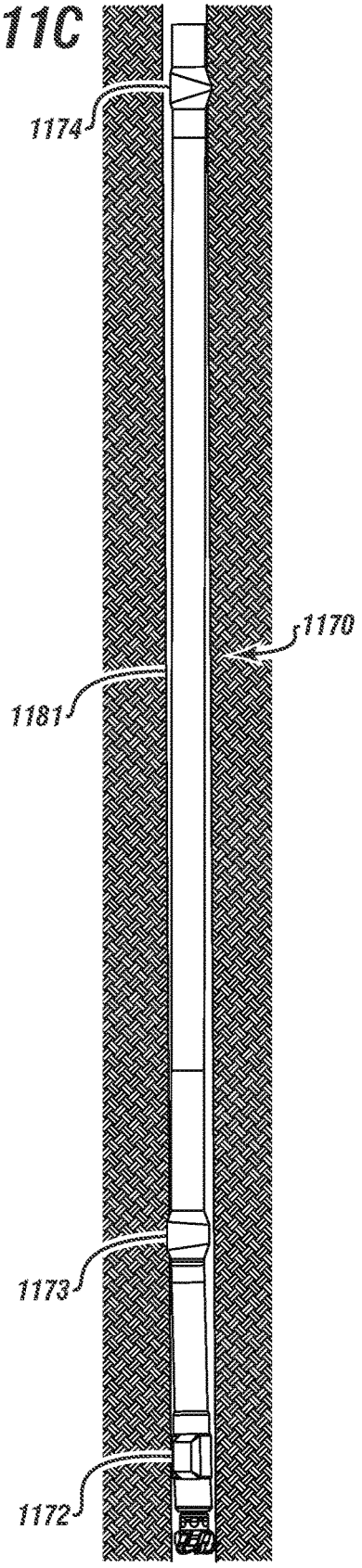

FIG. 11C shows the modified version 1170 of the directional drilling assembly now deployed in a straight wellbore

1181. Fully modified (non-interfering) member 1172 and partially modified members 1173 and 1174 are now in position to have the rotary drilling interference performed. The first modified model 1170 is simulated in a straight wellbore section to identify over engagement contact points using a rotary drilling mode, which over engagement contact points may be referred to as rotary mode over engagement contact points or the like.

Figure 11D:
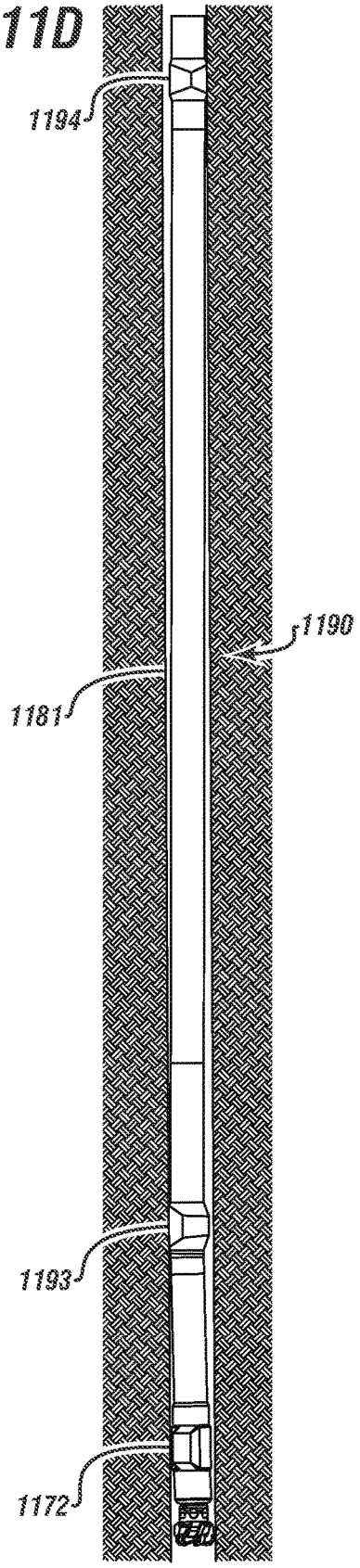

FIG. 11D shows the modified version 1190 of the directional drilling assembly deployed in straight wellbore 1181 with further stock removed from the previously partially modified mock members. The modified version 1190 may be referred to as a second modified model or a second modified directional drilling assembly. The generation of the model may be via a third modeling step to distinguish between the first modeling step showing the unmodified model above. Member 1172 has not undergone further modification but transmission housing member 1193 and upper housing member 1194 now reflect the additional stock removal resulting from the rotary drilling analysis performed in straight wellbore 1181. In this instance the modeled oversized hole diameter is 9.25 inches. The outer surface of the guidance positioners is now complete.

Figure 12A:
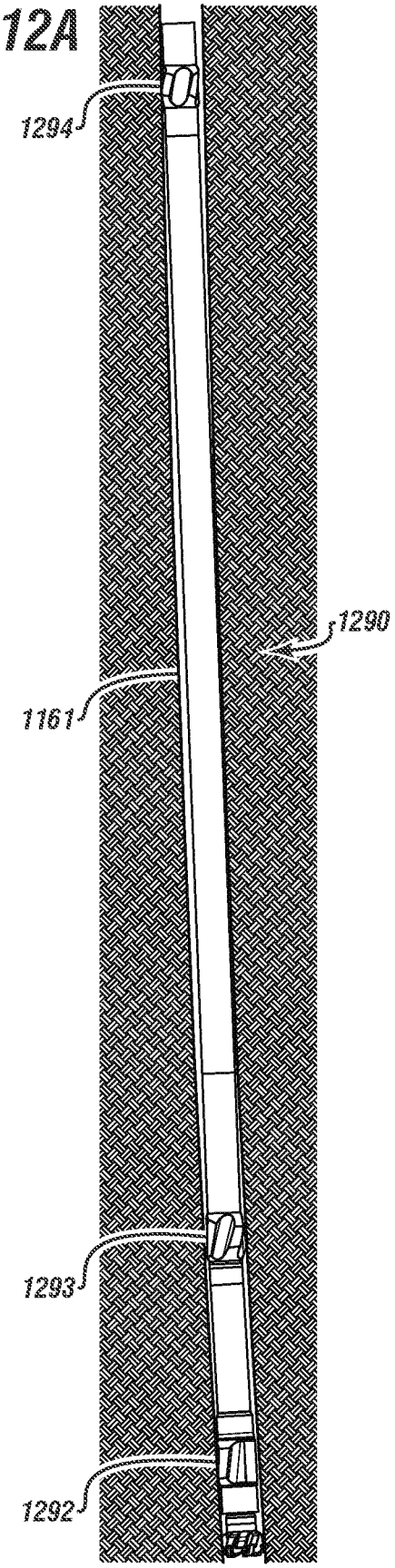
FIG. 12A shows the finished assembly from FIG. 11D, now with flutes in place on the guidance positioners, deployed in slide drilling mode in a curved wellbore.

FIG. 12A shows the finished assembly 1290 completed from the modified assembly 1190 from FIG. 11D. Finished assembly 1290 is shown deployed in slide drilling mode in a curved wellbore 1161. Assembly 1290 includes guidance positioners 1292, 1293, and 1294 with flutes added completing the modeling of the guidance positioners. These models are now ready for machining/manufacturing as discussed previously.

Figure 12B:
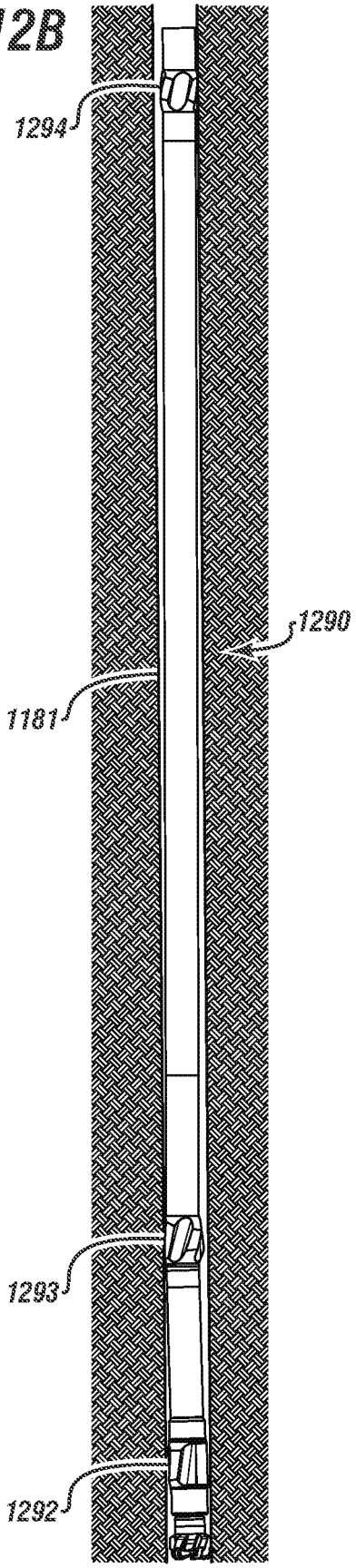
FIG. 12B shows the finished assembly from FIG. 11D, now with flutes in place on the guidance positioners, deployed in rotary drilling mode in a straight wellbore.

FIG. 12B shows the finished assembly 1290 completed from the modified assembly 1190 from FIG. 11D. Finished assembly 1290 is shown deployed in rotary drilling mode in a straight wellbore 1181. As can be appreciated, the guidance positioners 1292, 1293, and 1294 may have their outer surfaces machined to match the curvature of the wellbore in slide drilling mode. Also, as can be appreciated, the guidance positioners 1292, 1293, and 1294 may be fitted with cutters as mentioned to facilitate reaming of any transition lips associated with a directionally drilled wellbore as described above.

In accordance with the above finished assembly, having guidance positioners consistent with the technology, a wellbore may be drilled using the assembly. The wellbore would include both straight sections, which could be vertical sections, inclined sections, horizontal sections, or some combination thereof, as well as curved sections where the directional drilling assembly causes the wellbore to deviate from the axis of the subsequent wellbore section. Thus, directional drilling assembly would be provided on a drill string. The directional drilling assembly comprises a power section, a transmission section, a bearing portion, a bit portion, and a bend located below the power section and above the bit portion, the directional drilling assembly having at least an asymmetric near bit positioner located proximal the bit portion and at least an asymmetric upper bit positioner located above the bend. To directional drill the wellbore, the operator would cease the rotation of the drill string and orient the drill string such that the directional drilling assembly is oriented in a direction to drill the wellbore. The operator may use known methods to orient the directional drilling assembly including orienting the scribe line. The power section of the direction drill, which may be a positive displacement motor that receives its motive force from drilling mud flow, would be rotated to cause the bit on the bit portion to rotate separate from the remainder of the drill string to drill the wellbore.

In certain aspects, the wellbore is drilled substantially straight by rotating the drill string to drill a substantially straight section of the wellbore.

In certain embodiments, the guidance positioners may be designed such that blades modified by slide drilling mode will be axially displaced from blades modified by rotary drilling mode.

Although the technology of the present application has been described with reference to specific embodiments, these descriptions are not meant to be construed in a limiting sense. Various modifications of the disclosed embodiments, as well as alternative embodiments of the technology will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the technology. It should also be realized by those skilled in the art that such equivalent constructions do not depart from the spirit and equivalent constructions as set forth in the appended claims. It is therefore contemplated that the claims will cover any such modifications or embodiments that fall within the scope of the technology.

We claim:

1. A portion of a drill string comprising:
- a power section;
- a transmission section coupled with the power section;
- a bearing portion coupled with the transmission section;
- a bit portion coupled with the bearing portion;
- a bend located below the power section and proximal the transmission section;
- an upper positioner located above the bend, the upper positioner having a plurality of blades and flutes;
- a near bit positioner located above the bit portion, the near bit positioner having a plurality of blades and flutes;
- wherein the upper positioner has a shape that is axially asymmetric such that the shape of the upper positioner is asymmetric about an axis of rotation of the portion of the drill string; and
- wherein the near bit positioner has a shape that is axially asymmetric such that the shape of the near bit positioner is asymmetric about the axis of rotation of the portion of the drill string.

2. The portion of a drill string of claim 1, wherein at least one of the plurality of blades of the upper positioner has an outer surface shaped to conform to a curvature of a wellbore.

3. The portion of the drill string of claim 1, wherein the shape of the upper positioner is both axially and circumferentially asymmetric.

4. The portion of the drill string of claim 1, wherein a first portion of the plurality of blades are modified by rotary drilling mode and a second portion of the plurality of blades are modified by slide drilling mode, and wherein the first portion has a different shape than a shape of the second portion.

5. The portion of the drill string of claim 4, wherein the first portion is axially displaced from the second portion.

6. The portion of the drill string of claim 1, wherein an axial placement of the upper positioner is calculated based on a three point calculation.

7. The portion of the drill string of claim 1, wherein the shape of the near bit positioner is eccentric.

8. The portion of the drill string of claim 1, wherein upper positioner is located proximal the bend of the portion of the drill string on a scribe side of the portion of the drill string.

9. The portion of the drill string of claim 8, wherein the upper positioner is located based on a three point calculation on a high side of the portion of the drill sting.

10. The portion of the drill string of claim 1, wherein at least one of the plurality of blades of the upper positioner comprises a cutter configured to engage a lip on a wall of a wellbore.

11. A portion of a drill string comprising:

a power section;

a transmission section coupled with the power section;

a bearing portion coupled with the transmission section;

a bit portion coupled with the bearing portion;

a bend located below the power section and proximal the transmission section;

an upper positioner located above the bend;

a near bit positioner located above the bit portion;

wherein the upper positioner has a shape that is axially asymmetric such that the shape of the upper positioner is asymmetric about an axis of rotation of the portion of the drill string; and wherein the near bit positioner has a shape that is axially asymmetric such that the shape of the near bit positioner is asymmetric about the axis of rotation of the portion of the drill string.

12. The portion of a drill string of claim 11, wherein the upper positioner or the near bit positioner comprises a cutter configured to engage a lip on the wall of a well bore.

13. A method of drilling a wellbore comprising:

providing a directional drilling assembly on a drill string, wherein the directional drilling assembly comprises a power section, a transmission section, a bearing portion, a bit portion, and a bend located below the power section and above the bit portion, the directional drilling assembly having at least an asymmetrically shaped near bit positioner located proximal the bit portion and at least an asymmetrically shaped upper bit positioner located above the bend;

wherein the upper positioner has a shape that is axially asymmetric such that the shape of the upper positioner is asymmetric about an axis of rotation of the portion of the drill string, and wherein the near bit positioner has a shape that is axially asymmetric such that the shape of the near bit positioner is asymmetric about the axis of rotation of the portion of the drill string;

rotating the drill string about the axis of rotation in a rotary drill mode to drill a first section of a wellbore;

ceasing rotation of the drill string;

orienting the drill string such that the directional drilling assembly is oriented in a direction to drill the wellbore;

causing the power section to rotate the bit portion after orienting the drill string; and drilling the wellbore in a slide mode using the directional drilling assembly.

14. The method of claim 13, comprising rotating the drill string to drill a substantially straight section of the wellbore.

15. The method of claim 13, wherein orienting the drill string comprises orienting a scribe line on the drill string with the direction.

16. The portion of a drill string of claim 1, wherein at least one of the plurality of blades of the near bit positioner has an outer surface shaped to conform to the curvature of the wellbore.

17. The portion of the drill string of claim 1, wherein the shape of the near bit positioner is both axially and circumferentially asymmetric.

18. The portion of the drill string of claim 1, wherein the shape of the upper positioner is eccentric.

19. The portion of the drill string of claim 1, wherein each cross-section of the near bit positioner has a different shape than every other cross-section of the near bit positioner; and wherein each cross-section of the upper positioner has a different shape than every other cross-section of the upper positioner.

20. The portion of the drill string of claim 1, wherein each cross-section of the near bit positioner has a different area than every other cross-section of the near bit positioner; and wherein each cross-section of the upper positioner has a different area than every other cross-section of the upper positioner.

21. The portion of the drill string of claim 1, wherein each cross-section of the near bit positioner has different dimensions than every other cross-section of the near bit positioner; and wherein each cross-section of the upper positioner has different dimensions than every other cross-section of the upper positioner.

22. The method of claim 13, wherein each positioner includes a plurality of blades, the method comprising shaping a first portion of the plurality of blades for use in the rotary drill mode and shaping a second portion of the plurality of blades for use in the slide mode, and wherein the blades of the first portion have a different shape than the blades of the second portion.

23. The portion of the drill string of claim 1, wherein the plurality of blades of the upper positioner includes multiple blades having different shapes, and wherein the plurality of blades of the near bit positioner includes multiple blades having different shapes.

24. The portion of the drill string of claim 4, wherein the blades of the first portion are shallower and wider than the blades of the second portion.

* * * * *